US005596161A

United States Patent [19]

Sommers

[11] Patent Number: 5,596,161

[45] Date of Patent: Jan. 21, 1997

[54] MUZZLE FLASH SUPPRESSOR

[76] Inventor: Sonja Sommers, P.O. Box 671, Tempe, Ariz. 85280-0671

[21] Appl. No.: 501,370

[22] Filed: Jul. 12, 1995

[51] Int. Cl.[6] ..... F41A 21/34

[52] U.S. Cl. ..... 89/14.2; 89/14.3

[58] Field of Search ..... 89/14.05, 14.2, 89/14.3; D22/108

[56] References Cited

U.S. PATENT DOCUMENTS

| | | | |
|---|---|---|---|
| 2,870,679 | 1/1959 | Collins | 89/14.2 |
| 4,024,791 | 5/1977 | Stratman | 89/14.2 |
| 4,570,529 | 2/1986 | A'Costa | 89/14.2 |
| 4,664,014 | 5/1987 | Hawley et al. | 89/14.2 |
| 5,005,463 | 4/1991 | A'Costa | 89/14.2 |
| 5,092,223 | 3/1992 | Hudson | 89/14.2 |
| 5,433,133 | 7/1995 | La France | 89/14.2 |

OTHER PUBLICATIONS

DPMS (Defense Procurement Manufacturing Services, Inc.) Dealer Catalog, p. 42, 1995.

*Primary Examiner*—Michael J. Carone
*Attorney, Agent, or Firm*—Joseph W. Mott

[57] ABSTRACT

A firearm muzzle flash suppressor comprising a cylindrical body for attachment to the firearm barrel, having a plurality of open-ended helical flutes angled and offset in the direction of rotation of the exiting projectile.

10 Claims, 1 Drawing Sheet

MUZZLE FLASH SUPPRESSOR

STATEMENT OF THE INVENTION

This invention relates to flash hiding or flash suppression devices for firearm muzzles.

BACKGROUND OF THE INVENTION AND PRIOR ART

When a firearm is discharged, gases generated by combustion of an explosive mixture in the firearm chamber propel a projectile through the firearm barrel and out the muzzle. These propellant gases exit the muzzle in the wake of the projectile and mix with the ambient air. The exiting gases cause or contribute to three unwanted effects: muzzle flash, recoil/muzzle lift and interference with projectile stability.

Muzzle flash occurs as a result of the contact of the propellant with the air at the muzzle. The propellant gas mixture, containing traces of unburned powder, remains extremely hot at the end of the barrel. Oxygen in the surrounding air combines with the hot gas to enable combustion of the residual chemicals, resulting in a visible flash of light just beyond the end of the barrel. Muzzle flash is undesirable because it gives away the location of a shooter at night or under other low ambient light conditions.

Recoil is the reactive force against the gun barrel applied by the moving bullet and propellant. A substantial component of this reactive force is created by the forward ejection of the propellant out the muzzle. The recoil force is applied at a point above the center of gravity of the firearm and this, combined with the torque reaction generated by the rapidly spinning projectile, tends to pull the muzzle upward and to the right upon firing.

Projectile stability is affected by the exiting propellant gas that passes and surrounds the projectile immediately beyond the muzzle. The velocity of the propellant is roughly twice the velocity of the projectile, so that at exit some propellant moves around and in front of the projectile. The propellant immediately slows down in the air, causing drag on the projectile. More significantly, in the case of a firearm with a rifled barrel, the propellant exerts a force that makes the spinning projectile wobble or "yaw", thereby causing the projectile to take longer to stabilize and decreasing the accuracy of the firearm.

A number of approaches to suppressing or hiding muzzle flash, alone or in combination with lessening recoil, appear in the prior art. In U.S. Pat. No. 4,024,791, for example, a barrel extension with rear-angled holes is employed to draw ambient air into the barrel behind the moving projectile to cool the propellant gas so that combustion at the exit point is reduced or eliminated. The same patent also features adding longitudinal baffles inside the barrel extension to permit expansion and resultant additional cooling of the propellant gases before exit.

The standard, government-issue flash hider used on military automatic and semi-automatic weapons such as the AR-15 and M-16 is illustrated in U.S. Pat. No. 5,092,223 for a muzzle brake that may be utilized in connection with the flash hider. The government-issue flash hider is of the "bird cage" type, designed with a conical, expanding internal diameter barrel extension with slotted longitudinal openings along part of its length. The propellant gases expand (thereby cooling) in the hider barrel, and exit the longitudinal slots. Unfortunately, sufficient heat and pressure remain to permit visible combustion and flash.

U.S. Pat. No. 4,570,529 also employs a "bird cage" design, but adds a length of smoothbore barrel between the weapon and the "bird cage" to elongate the moving bullet and provide further burn time for the propellant. An improvement, shown in U.S. Pat. No. 5,005,463 changes the "bird cage" to a pair of diametrically opposed vent slots, creating a pair of furcations, each of which has at least one radially directed vent opening. A flash suppressor design available on the market is made up of a barrel extension with three straight prongs, leaving open slots between the prongs. These designs result in some suppression of muzzle flash, but leave more residual flash than is desirable.

BRIEF DESCRIPTION OF THE INVENTION

The flash suppressor of the present invention takes advantage of the aerodynamics of the propellant gases and projectile in a rifled barrel. The rifling imparts a spin on the bullet perpendicular to the direction of motion. This spin stabilizes the projectile as it travels through the air. The spinning of the projectile also imparts a spin on the adjacent trailing propellant and the shock wave ahead of the projectile, so that the leading air and trailing gas is rotating in the direction of the rifling (generally clockwise) as it exits the barrel. By employing offset, helical flutes in the same orientation as the gas rotation in a barrel extension, the flash suppressor of the present invention facilitates the radial and forward outward flow of the air ahead of the projectile and the exiting trailing propellant. The flutes extend all the way to the distal end of the device, so no barrier is presented to the forward and outward motion of the expanding air and gas. The rotational outward flow of the leading shock wave draws with it the air in the immediate vicinity of the muzzle, preventing oxygen from combining with the hot propellant gases immediately upon the propellant's exit from the muzzle. Directed outward expansion then cools the propellant and dissipates the unburned powder and also generates a vacuum to pull the remaining propellant behind the projectile outward away from the projectile.

The dissipation and cooling of the propellant gas not only suppresses the burning necessary for a flash, but also decreases recoil by directing a portion of the exiting propellant gases radially from the barrel and reduces muzzle lift by neutralizing some of the reaction to the torque generated by the spinning bullet. Finally, most of the propellant is drawn away from the projectile as it exits the firearm barrel, so that it does not exert a force to cause the projectile to yaw.

Thus it is one object of this invention to provide an improved form of flash suppressor to more effectively eliminate the post-exit propellant combustion and resultant visible flash attendant to discharging a firearm.

It is a further object of this invention to dissipate some of the reactive gas forces that contribute to the firearm recoil and muzzle lift.

It is a further object of this invention to draw the high-velocity exiting propellant away from the projectile to lessen the propellant's drag and the propellant's tendency to cause projectile yaw, thus leaving the projectile with greater velocity and stability.

It is a further objective of this invention to accomplish the foregoing with a device that is convenient and compatible with standard firearms.

DESCRIPTION OF A PREFERRED EMBODIMENT OF THE INVENTION

Figure 1:
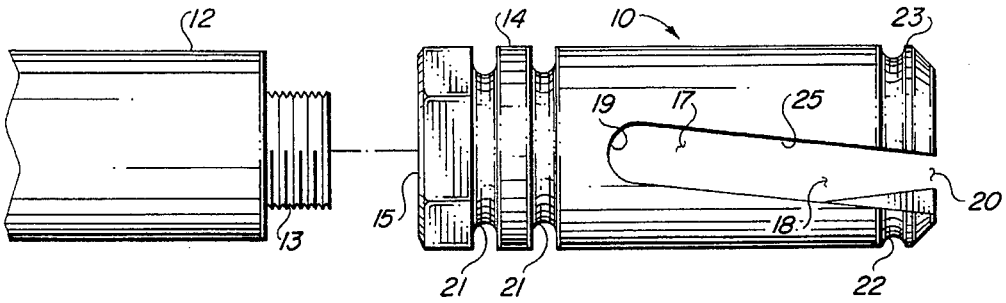
FIG. 1 is a side view of one embodiment of the flash suppressor of the present invention.
Figure 2:
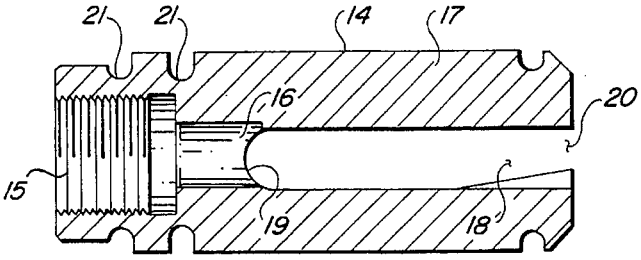
FIG. 2 is a lengthwise cross sectional view of the embodiment of FIG. 1.
Figure 3:
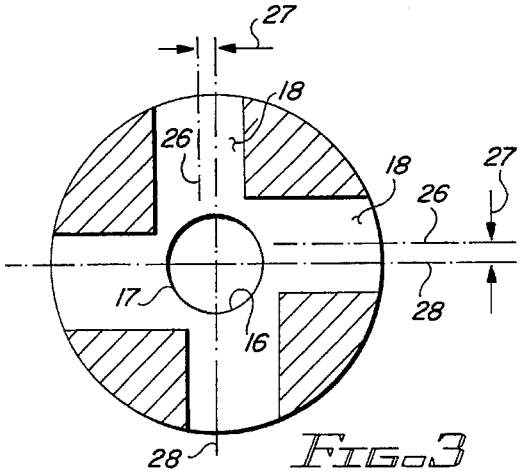
FIG. 3 is an end-on cross sectional view of the embodiment of FIG. 1.

FIGS. 1, 2 and 3 show the preferred embodiment of the present invention. It depicts a flash suppressor 10 configured for use with standard United States military weaponry, particularly the AR-15 and M-16 firearms. These firearms have a standard bore of .223 caliber (5.56 mm). Such firearms have a barrel 12 with a conventional male threaded extension 13. Flash suppressor 10 generally includes cylindrical body member 14 which has a threaded recess 15 for receiving the extension 13 of the gun barrel 12.

The flash suppressor is a cylindrical barrel extension approximately 2¼ inches (5.7 cm) long and 0.86 inches (21 mm) in outside diameter, made of 86L20 combat grade steel with surface hardening and black military finish. Other grades of material (e.g., 12L14 steel) and finish (e.g. blue) would be acceptable for civilian use.

Cylindrical body 14 includes an axial passageway 16 of diameter slightly larger than the bore of the firearm to which the flash suppressor is attached. The axial passageway is approximately 0.25 inches (6.3 mm) long and connects to exit chamber 17 having a diameter roughly 1.5 times that of axial passageway 16. The diameter of the exit chamber is large enough so that the exiting projectile will not touch any portion of the device as it proceeds. The body of the flash suppressor surrounding the exit chamber has four equally-spaced helical flutes 18 running the length of exit chamber 17. Flutes 18 have radius ends 19 at their proximal ends and are open at their distal ends 20. As may be seen on FIG. 3, the centerlines 26 of flutes 18 are slightly offset 27 from the bisecting centerlines 28 of the body.

In the .223 caliber (5.56 mm) embodiment, flutes 18 are 0.25 inches (6.3 mm) wide and 1.4 to 1.5 inches (35 to 38 mm) long, with a ⅛ inch (3 mm) radius curve at their proximal ends. Experimentation has shown that flash suppression is optimized for this embodiment when the flutes are set at an angle 25 of 6 degrees clockwise from the centerline and the offset is 0.75 inches (19 mm) in the same direction. If for some reason the rifling of the gun barrel were counterclockwise, the flutes would be angled and the offset would be set counterclockwise. Experimentation has shown that use of an angled flute that is not offset, or of a straight flute that is offset, improves flash suppression over the devices known in the art, but the combination of angle and offset optimizes the operation of the device.

The military embodiment also includes a pair of radial attachment rings 21 for securing a blank firing device (not shown) during training. It also includes a forward snap ring groove 22 and 45° bevelled front surface 23 to facilitate mounting of a snap ring type brush guard (not shown). It should be noted that the ring-type brush guard, when in place, will impede the forward and outward release of propellant gas and impair the flash suppression effectiveness of the device.

In operation, the flash suppressor is simply screwed onto the end of the barrel extension until it stops. When the weapon is fired, the exiting spinning bullet proceeds through axial passageway 16 and through exit chamber 17. The spinning shock wave ahead of the bullet moves forward and outward, drawing the air in the exit chamber with it. Propellant gas does not immediately ignite in the evacuated exit chamber due to a lack of oxygen, and then is expelled forward and outward through the flutes, cooling and dispersing the gas before it combines with enough oxygen to ignite. Drawing the gas outward also decreases friction on the spinning bullet, making the bullet's trajectory more stable, and decreases the reactive torque exerted by the spinning gas on the barrel. Finally, the reactive force of the gas on the angled flutes causes the flash suppressor to tighten itself onto threaded extension 13, eliminating any concern that the flash suppressor will become unscrewed during extended fire.

Figure 4:
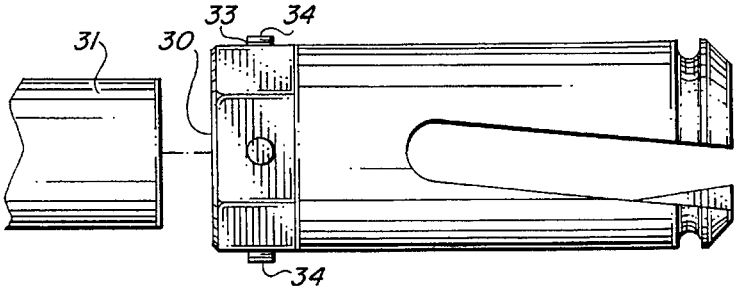
FIG. 4 is a side view of an alternative embodiment of the invention.
Figure 5:
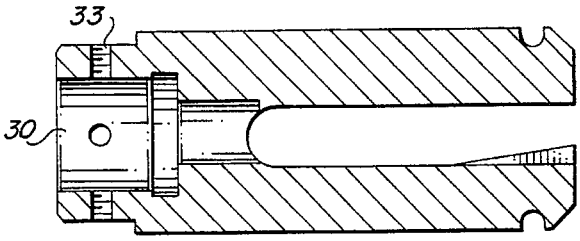
FIG. 5 is a cross sectional view of the embodiment of FIG. 3.

Another embodiment is shown in FIGS. 3 and 4. This embodiment is designed to be attached to a barrel that lacks the threaded extension of the AR-15 and M-16. In this embodiment, cylindrical body member 14 has an unthreaded cylindrical recess 30 with an inside diameter slightly larger than the outside diameter of firearm barrel 31. Axial passageway 32 is aligned with, and has a diameter slightly larger than the bore of the firearm. Four threaded apertures 33 for set screws are spaced equally around body member 14 near the proximal end, and set screws 34 are inserted and tightened against the gun barrel. Other conventional structures for attaching a barrel extension to a firearm, depending upon the shape and configuration of the firearm barrel, can also be used.

Although the present invention has been described in considerable detail with reference to certain preferred versions thereof, other versions are possible. For example, persons of ordinary skill in the art will readily ascertain that the dimensions may be appropriately scaled for firearms with differing bore sizes. Therefore, the spirit and scope of the appended claims should not be limited to the description of the preferred versions contained herein.

I claim:

1. A firearm muzzle flash suppressor comprising a generally cylindrical body member with a proximal end for attachment to a firearm barrel having a rifled bore and a distal end for exit of a projectile from the body member, a recessed portion at the proximal end adapted to receive the firearm barrel, an axial passageway having a diameter slightly greater than the firearm bore connecting the recessed portion to an exit chamber of diameter substantially greater than the firearm bore, said exit chamber including a plurality of helical angled flutes angled in the direction of rifling of the firearm bore and being open at the distal end of the body member, and a means for attaching the body member to the firearm barrel.

2. The flash suppressor of claim 1 wherein the centerlines of the angled flutes are slightly offset in the direction of said rifling from a centerline drawn through the body member.

3. The flash suppressor of claim 1 wherein the recessed portion is threaded to receive a threaded extension portion of the firearm barrel.

4. The flash suppressor of claim 2 wherein the recessed portion is threaded to receive a threaded extension portion of the firearm barrel.

5. The flash suppessor of claim 1 wherein the means for attaching to the barrel comprises at least one set screw and aperture for the set screw.

6. The flash suppessor of claim 2 wherein the means for attaching to the barrel comprises at least one set screw and aperture for the set screw.

7. The flash suppressor of claim 1 including four equally spaced flutes angled six degrees from a centerline of the body member.

8. The flash suppressor of claim 2 including four equally spaced flutes angled six degrees from a centerline of the body member.

9. The flash suppressor of claim 7 further including attachment ring grooves for mounting a military blank firing device and a groove and angled front face at the distal end of the body member for mounting a snap ring brush protector.

10. The flash suppressor of claim 8 further including attachment ring grooves for mounting a military blank firing device and a groove and angled front face at the distal end of the body member for mounting a snap ring brush protector.

* * * * *